US006986623B2

(12) United States Patent
Robertson, Jr.

(10) Patent No.: US 6,986,623 B2
(45) Date of Patent: Jan. 17, 2006

(54) METHOD AND APPARATUS FOR ANCHORING A MINE ROOF BOLT

(76) Inventor: Roy Lee Robertson, Jr., Route 52, P. O. Box 493, Delbarton, WV (US) 25670

( * ) Notice: Subject to any disclaimer, the term of this patent is extended or adjusted under 35 U.S.C. 154(b) by 0 days.

(21) Appl. No.: 10/730,670

(22) Filed: Dec. 8, 2003

(65) Prior Publication Data

US 2005/0123361 A1 Jun. 9, 2005

(51) Int. Cl.
*E21D 21/00* (2006.01)

(52) U.S. Cl. ..... 405/259.4; 405/259.6; 405/288; 405/302.1

(58) Field of Classification Search ..... 405/259.4, 405/302.1, 288, 259.6
See application file for complete search history.

(56) References Cited

U.S. PATENT DOCUMENTS

| | | | | | |
|---|---|---|---|---|---|
| 4,173,918 | A | * | 11/1979 | Piersall | 411/51 |
| 4,413,930 | A | * | 11/1983 | Calandra, Jr. | 405/259.6 |
| 4,419,805 | A | | 12/1983 | Calandra, Jr. | |
| 4,516,886 | A | | 5/1985 | Wright | |
| 4,557,631 | A | | 12/1985 | Donan, Jr. et al. | |
| 4,564,315 | A | | 1/1986 | Rozanc | |
| 4,626,139 | A | | 12/1986 | Blackwell | |
| 4,664,561 | A | | 5/1987 | Frease | |
| 4,704,053 | A | | 11/1987 | Hipkins, Sr. et al. | |
| 4,784,530 | A | | 11/1988 | Price, Jr. | |
| 4,848,971 | A | * | 7/1989 | Price Jr. | 405/259.6 |
| 5,042,961 | A | | 8/1991 | Scott et al. | |
| 5,064,311 | A | | 11/1991 | Giroux et al. | |
| 5,073,065 | A | | 12/1991 | Kleineke | |
| 5,184,922 | A | | 2/1993 | Blackwell | |
| 5,203,647 | A | | 4/1993 | Blackwell | |
| 5,219,248 | A | * | 6/1993 | Wright | 405/259.4 |
| 5,232,311 | A | * | 8/1993 | Stankus | 405/259.4 |
| 5,244,314 | A | * | 9/1993 | Calandra, Jr. et al. | 405/259.4 |
| 5,501,551 | A | | 3/1996 | Wright | |
| 5,885,031 | A | | 3/1999 | White | |
| 6,146,055 | A | | 11/2000 | White | |
| 6,474,910 | B2 | * | 11/2002 | Lay | 405/259.4 |
| 6,742,966 | B2 | * | 6/2004 | Cook | 405/259.4 |

* cited by examiner

*Primary Examiner*—Frederick L. Lagman
(74) *Attorney, Agent, or Firm*—Robert R. Waters

(57) ABSTRACT

An improved mine roof bolt is disclosed. The mine roof bolt comprises a bolt portion having a camming nut rigidly fixed to it and a threaded end and an expansion shell having a central threaded nut with wedge fingers extending from it. The expansion shell is threaded onto the threaded section of the bolt. Turning the bolt while it is in a hole causes the expansion shell to move along the bolt and brings the wedge fingers into contact with the camming nut, spreading the wedge fingers into contact with the hole sides. As the turning of the bolt continues, the relative movement of the camming nut and wedge fingers increases the wedging effect within the hole until the bolt is anchored in the hole. While turning of the bolt may serve to mix a catalytic adhesive, the adhesive is not needed to activate the mechanical anchoring mechanism of the mine roof bolt.

39 Claims, 7 Drawing Sheets

METHOD AND APPARATUS FOR ANCHORING A MINE ROOF BOLT

BACKGROUND OF THE INVENTION

1. Field of the Invention

This invention relates generally to an apparatus and method for anchoring devices in rock material. More specifically, it relates to mine roof bolts and methods of using them to support the rock layer exposed in mine roofs by drilling holes in the roofs and mechanically and adhesively anchoring the bolts to higher layers of rock.

2. Description of the Related Art

Mine shafts sometimes experience cave-ins, collapses, or falling rock due to the layered and stratified makeup of the earth. A mine shaft itself may cause fractures and weaknesses in a strata in its ceiling, or it may just expose an inherently weak and unstable layer. To assist in preserving the integrity of the ceiling, it is common to support the ceiling with bolts anchored up into rock layers above the ceiling. Plates between the bolt heads on the exposed ends of the bolts and the ceilings are used to transfer force from the anchored bolts to the exposed layer of the ceiling. In some applications, the exposed end of the anchored bolt is threaded. Onto these bolts, a nut is threaded, and the nut used to place a preload on the bolt to set an initial lifting force to the plates.

Holes, which are slightly oversized to the bolts, are drilled up into the ceiling. Sometimes the holes must be several feet deep to be sure of anchoring the bolts in a stable layer of rock. Once the holes are drilled, the bolts are inserted into the holes and anchored. There are three methods for anchoring the bolts in the holes, mechanical, adhesive, and mechanically assisted adhesive. This patent relates mostly to the mechanical method or the mechanical aspect of the mechanically assisted adhesive method of anchoring bolts, so the adhesive method will be discussed only briefly before discussing the relevant mechanical art.

Once the hole is drilled, a multi-component adhesive is placed in the blind end of the hole. The components of the adhesive are kept in separate frangible packages to keep them from mixing, for, once they do, a reaction occurs, and the adhesive begins to set up. The components of the adhesive are usually a hardener and a catalyst. When the frangible packages have been placed in the hole, a bolt is inserted and turned rapidly to rupture the packages and thoroughly mix the adhesive components. The adhesive is typically of a fast setting variety and may begin to set after three to five seconds of mixing. For many mechanical anchoring methods, the mechanical anchoring elements on the bolt assist in mixing the adhesive, and the increased resistance to mixing of the setting adhesive activates the mechanical anchoring system.

A very common mechanical anchoring system is shown in U.S. Pat. No. 4,419,805 by Calandra, Jr. This system comprises, basically, a bolt with a threaded end, a camming nut having through its axis a threaded hole to match the bolt, a wooden dowel, and an expansion shell. The camming nut has several sides, the sides being at an angle to the axis of the camming nut to create a wedge effect so that one end of the camming nut is larger than the other. Also, the camming nut has a hole through it transverse to the axis of the camming nut. The diameter of this transverse hole and that of the wooden dowel pin match each other with the length of the dowel pin matching the length of the transverse hole. The expansion shell has at one end a solid ring. The inner diameter of this ring is slightly larger than the bolt diameter.

From this ring, several wedge fingers extend in a direction parallel to the axis of the hole. These fingers are equal in number to the sides of the camming nut and, having a wedge shape, taper as they extend away from the ring.

In operation, the expansion shell is placed over the bolt with the tapered wedge fingers pointing up. The wooden dowel is put through the hole in the camming nut, and the camming nut screwed onto the bolt until the dowel pin stops the bolt from passing any further into the camming nut. The expansion shell is pushed up onto the camming nut with the wedge fingers of the expansion shell aligning with the tapered sides of the camming nut. When an anchor hole has been drilled and filled with the adhesive pouches, the bolt is inserted into the hole and turned rapidly to rupture the pouches and mix the adhesive components. The anchoring components on the bolt serve to mix the adhesive. The rapidly setting adhesive provides resistance to the turning of the anchoring elements until the resistance is great enough to cause the bolt shaft to shear the wooden dowel in the camming nut. Once that occurs, the threads begin to pull the camming nut further onto the bolt and into the wedge fingers of the expansion shell. As the camming nut advances into the expansion shell the wedge fingers are expanded out to wedge in the wall of the anchor hole. The wedging of the expansion shell should stop the turning of the bolt before the adhesive sets. Otherwise, as the adhesive sets, a still turning bolt will cause the adhesive to set as small discrete particles as opposed to a single homogeneous anchor. Once the mechanical anchor is set, the bolt can have a preload placed on it. If a mechanical anchor is not used, an operator must wait until the adhesive sets to preload the bolt. So, while the adhesive provides the strongest anchor, the mechanical anchor makes the bolt system more time efficient and therefore more economical.

An additional feature in Calandra, Jr. is the use of a washer to contain the adhesive after the frangible pouches are ruptured and the adhesive is mixed. The washer has an inner diameter closely matching the bolt diameter and an outer diameter approximating that of the hole. It is located below the anchor elements at a position that keeps the adhesive contained in a small enough volume that the adhesive essentially fills the volume. The washer may be fixed in position by a press fit on the bolt or it may be welded in place.

Another common type of mechanical anchor used in mine bolts is the bail type anchor. It has a tapered camming nut and tapered wedge fingers like in the previous type, but the tapered wedge fingers are connected to each other at their thinner upper end by a bail. The bail passes up along the outside of the camming nut and across the top of the camming nut at its wider end. A groove in the camming nut allows the bail to stay within the profile of the camming nut, and in most of these bail type anchors, the wedge fingers are not connected by a ring at their thicker end. In this type of anchor, the resistance of the adhesive causes the camming nut, wedge fingers, and bail to turn more slowly than the bolt, so the bolt begins to advance up through the camming nut until it contacts the bail across the top of the camming nut. At that point, the bolt begins to lift the bail off of the top of the camming nut, and the bail then begins to pull the tapered wedge fingers up toward the camming nut. As the tapered wedge fingers and camming nut become more engaged, the wedging effect between the camming nut, tapered wedge fingers, and the hole sides increases. The bail may break once the camming nut and tapered wedge fingers are sufficiently wedged, if the bolt continues to advance through the camming nut. Once the mechanical anchor is set, a preload is placed on the bolt. Subsequently, the resin fully sets.

Many inventions in this field are directed to additional means for mixing the adhesive as well as the anchoring mechanism. U.S. Pat. No. 4,516,886 by Wright features a bail type anchor that has a two part bail to improve the mixing of the adhesive components. In addition to the bail that passes directly over the camming nut, a second bail extends above the camming nut, effectively providing an elongated hoop to puncture the component pouches and mix the adhesive. The bail that runs directly across the top of the camming nut has a hole through it slightly smaller than the bolt hole in the camming nut. The resistance of the adhesive causes the bolt to force its way through the first bail and advance through the camming nut until the bolt reaches the extended bail which begins to pull the tapered wedge fingers into wedging action with the camming nut and hole sides. Other patents add different mixing means. U.S. Pat. No. 5,042,961, by Scott, fixes a helix shaped length of wire to the bolt below the wedging mechanism, while U.S. Pat. No. 5,073,065, by Kleineke, places an adhesive mixing and retention washer on a tapered shoulder below the anchoring mechanism.

The use of the setting adhesive to drive the wedging action of the mechanical portion of the various anchoring systems has severe drawbacks. Obtaining complete mechanical engagement before the adhesive sets is very time dependent. Variations in the mechanical components, in particular, may prove problematic. The strength of wood shear pins may vary widely. If a sheer pin does not break and the expansion shell is still churning as the adhesive sets, the adhesive may set as small disassociated particles as previously discussed. Once that occurs, the resulting adhesive gravel may provide enough resistance to activate the mechanical anchor, and the bolt may anchor mechanically. However, the adhesive anchor is lost and it is the adhesive anchor that provides the majority of the long term strength of the anchoring system. This is particularly dangerous since the bolt appears to be anchored, but the superior long term anchor of the adhesive component has been lost. Because of the appearance of a good anchor, remedial measures such as placing another bolt immediately nearby are not undertaken. The resulting weakly anchored roof bolt is often called a "spinner" in the mining industry.

Occasionally, if it is obvious to an operator that a mechanical anchor is not actuating, the operator may pause long enough for the resin to nearly set, and then resume turning the bolt. This brings about the destruction of the adhesive, but will pull the bolt up tight for a preload and will give the appearance of a successful anchoring. However, the actual result is a "spinner".

Some types of rock are particularly soft. This, too, is a problem. The mechanical anchor may widen the hole as it turns and fail to pull tight within the hole. If it continues to turn in a loosened hole, again, the adhesive is at risk.

Another problem is more specific to the mechanical elements of the anchoring systems that use expansion shells having the tapered wedge fingers joined by a common ring at the base with a camming nut being drawn into the expansion shell. These systems typically have four sides on the camming nut and four tapered wedge fingers on the expansion shell with each tapered wedge finger being driven out to the hole wall by a corresponding camming nut side. Sometimes the camming nut will turn within the expansion shell, twisting the wedge fingers to an angle about the axis of the bolt and preventing an effective anchoring in the hole. Again, this substantially decreases the overall holding power of the bolt, allowing ceiling collapses where the load exceeds the strength of the anchor.

SUMMARY OF THE INVENTION

The present invention is an improved mine roof bolt having a main bolt shaft with a threaded end, a fixed camming nut, and threaded expansion shell. It has a more easily activated mechanical anchor and an overall simpler design than the prior art.

Accordingly, it is a primary objective of this invention to improve mine safety by decreasing the rate of occurrence of "spinners" in mine roof bolts.

It is a further objective of this invention to provide a mine roof bolt with a mechanical anchoring system that is not dependent on a setting adhesive for activation.

It is also an objective of this invention to provide a mine roof bolt that is easier to anchor in a receiving bolt hole.

It is a another objective of this invention to provide a mine roof bolt that has fewer moving parts in the mechanical anchoring system.

It is a still further objective to provide a mine roof bolt which decreases the occurrence of twisting of the expansion shell.

It is yet another objective of this invention to provide a mine roof bolt system that does not use a shear pin such as the wooden dowel discussed above in the relevant art.

It is still yet another objective of this invention to provide a mine roof bolt that can be used without an adhesive altogether.

It is still yet a further objective of this invention to provide a mine roof bolt having a built in timer function.

As discussed above, the article of the present invention overcomes the disadvantages inherent in prior art methods and prior art devices for anchoring a mine roof bolt. In this respect, before explaining at least one embodiment of the invention in detail, it is to be understood that the invention is not limited in its application to the details of construction and/or to the arrangement of the support structure set forth in the following description or illustrated in the drawings. The invention is capable of other embodiments and of being practiced and carried out in various and diverse ways. Also, it is to be understood that the phraseology and terminology employed herein are for the purposes of description and should not be regarded as limiting.

Accordingly, those skilled in the art will appreciate that the concept upon which this invention is based may readily be utilized as a basis for the design of other structures, methods, and systems for carrying out the purposes of the present invention. It is important, therefore, that the claims be regarded as including such equivalent constructions insofar as they do not depart from the spirit and scope of the present invention.

Furthermore, the purpose of the foregoing Abstract is to enable the U.S. Patent and Trademark Office and the public generally, and especially including the practitioners of the art who are not familiar with patent or legal terms or phraseology, to determine quickly from a cursory inspection, the nature and essence of the technical disclosure of the application. The Abstract is neither intended to define the invention of the application, nor is it intended to be limiting to the scope of the invention in any respect.

BRIEF DESCRIPTION OF THE DRAWINGS

Additional utility and features of this invention will become more fully apparent to those skilled in the art by reference to the following drawings, wherein all components are designated by like numerals and described more specifically.

FIG. 12 shows a bolt portion of a mine roof bolt system having different diameters with a tapered section in between.

DETAILED DESCRIPTION OF PREFERRED EMBODIMENT

Figure 1:
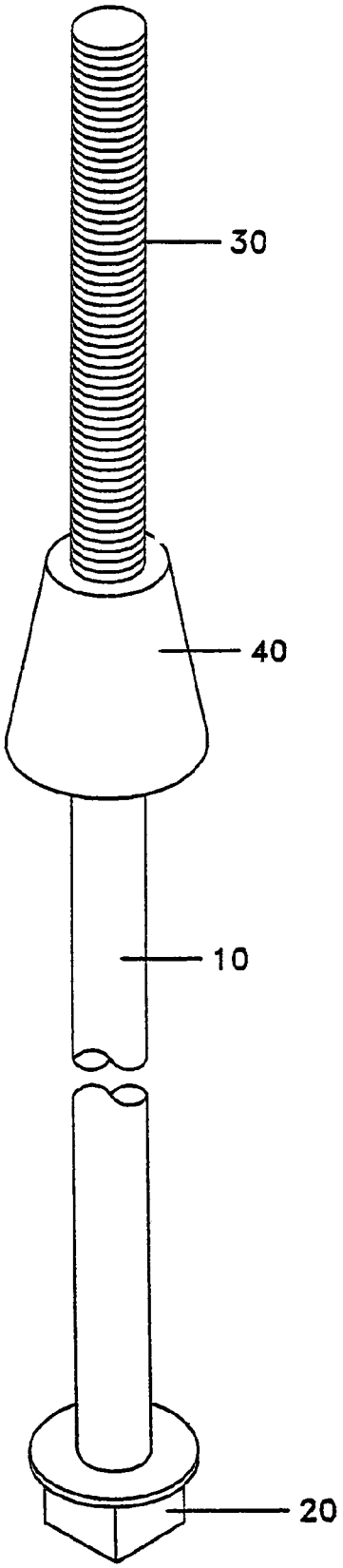
FIG. 1 is an isometric view of the bolt portion of the instant invention.
Figure 2:
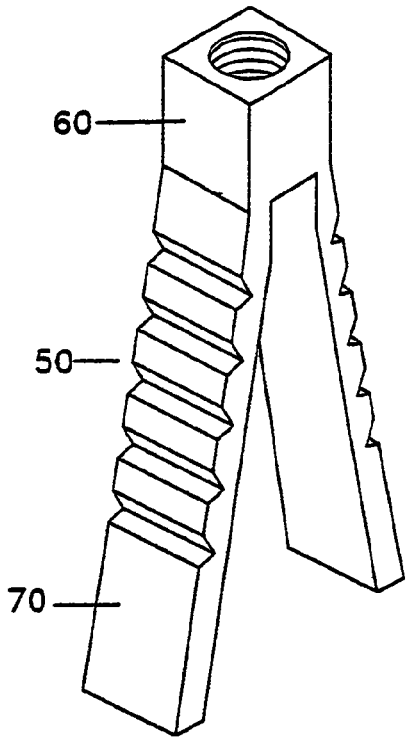
FIG. 2 is an isometric view of the expansion shell portion of the instant invention.
Figure 3:
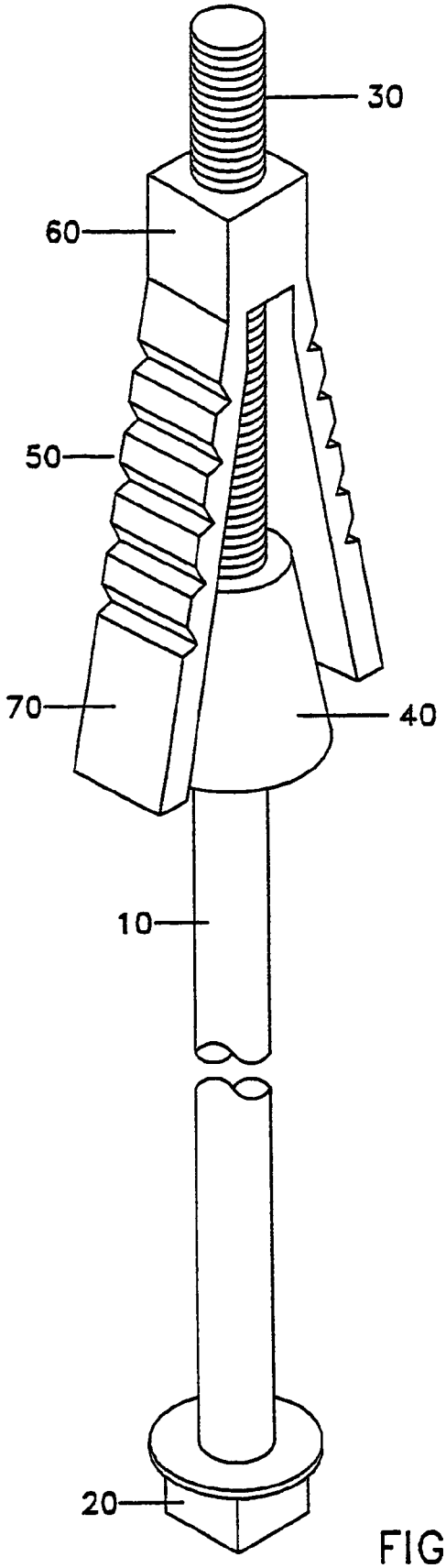
FIG. 3 is an isometric view of the bolt portion and expansion shell portion assembled.
Figure 4:
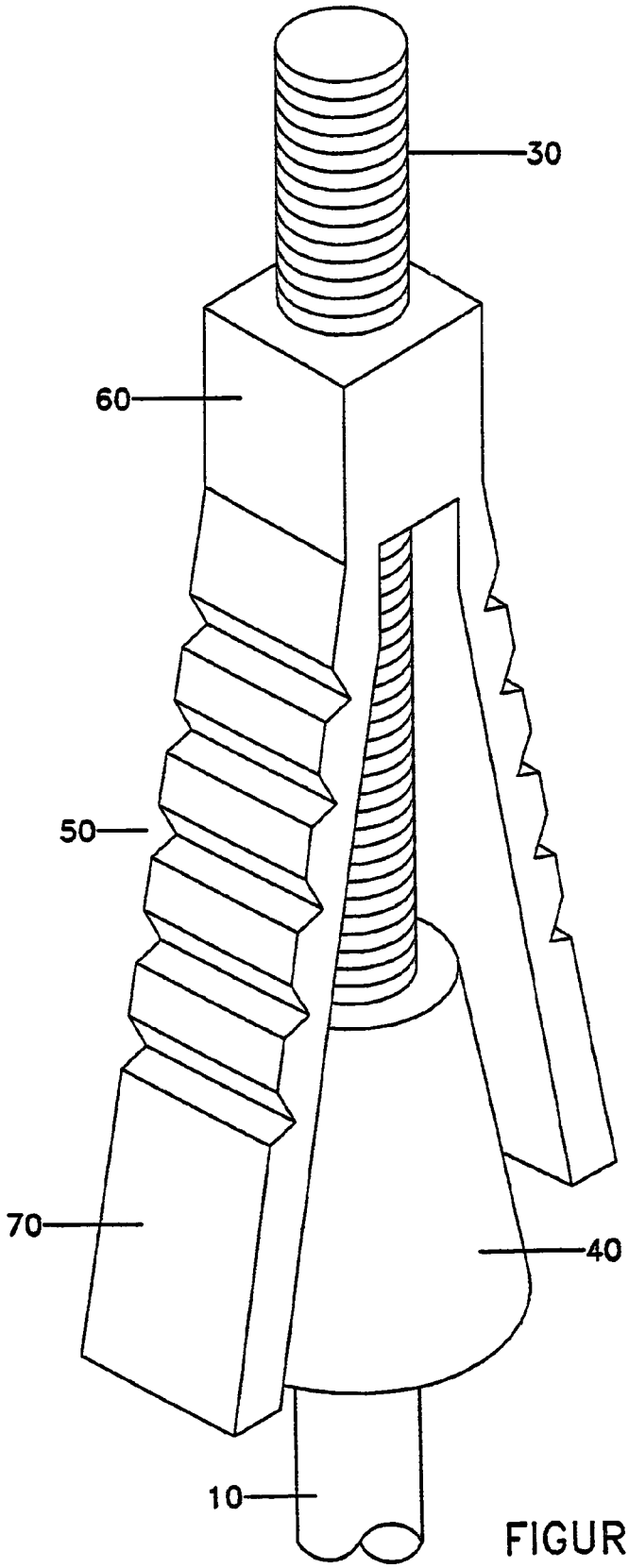
FIG. 4 is an enlarged isometric view of the working parts of the instant invention.
Figure 5:
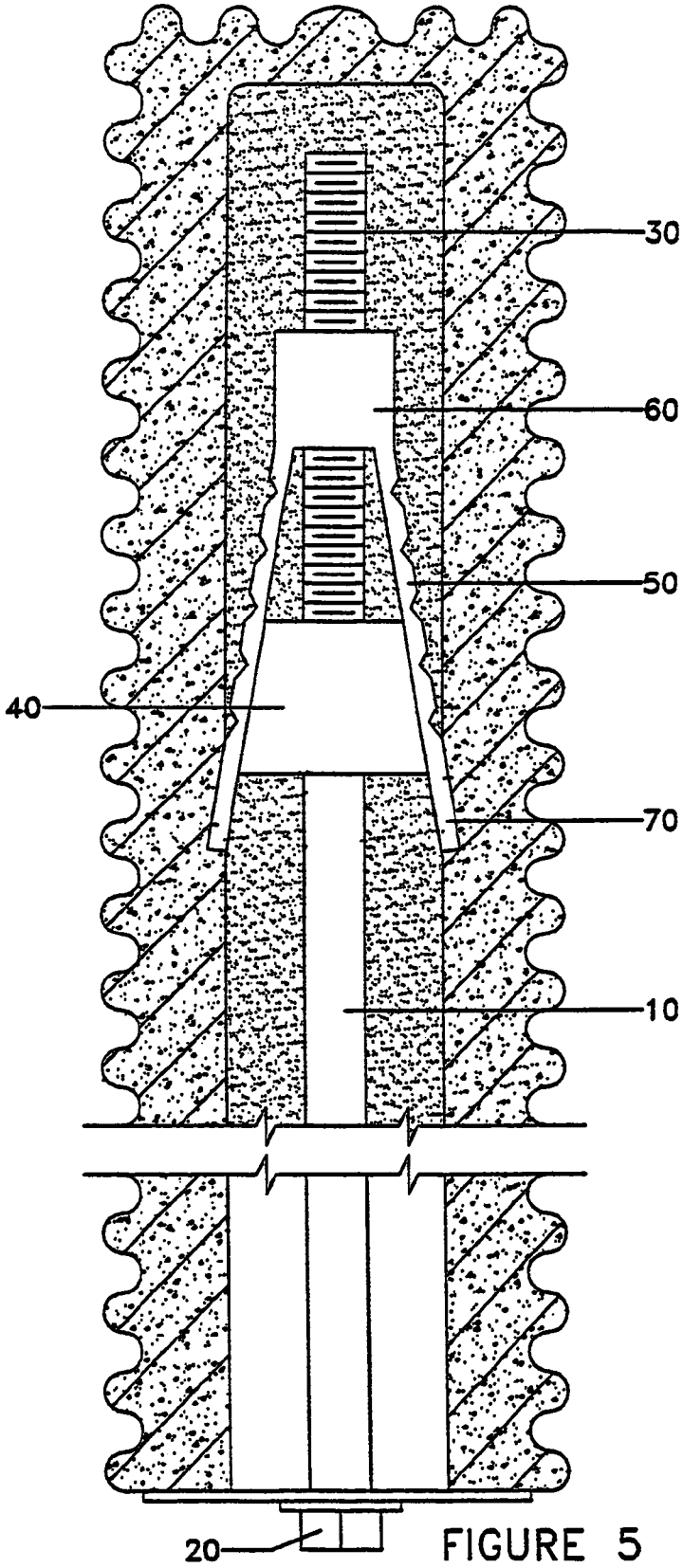
FIG. 5 shows a mine roof bolt of the instant invention anchored in a hole.

The following discussion illustrates only some of the possible configurations claimed in this invention and should not be interpreted as limiting the scope of the claims. FIG. 1 depicts the bolt portion (10) of the mechanical anchoring system. The bolt has a means for turning it (20) via a driver or wrench on one end, machine threads (30) on the other end, and a camming nut (40) fixed on the shaft of the bolt (10) at a position nearer to the machine threads (30). FIG. 2 shows an expansion shell (50) having as its central component a threaded nut portion (60), and at least two, in this case two, wedge fingers (70) extending from the threaded nut portion (60) in a direction essentially parallel to the axis of the hole through the threaded nut portion (60). FIG. 3 shows the expansion shell (50) threaded onto the machine threads (30) of the bolt portion (10) with the wedge fingers (70) directed towards the camming nut (40).

To use the bolt assembly (80), it is inserted into a drilled hole in the roof of a mine shaft until the load bearing plate contacts the mine roof. The bolt (10) is turned while the expansion shell (50) is kept from rotating, either by contact of the wedge fingers (70) with the sides of the hole or by a setting adhesive, which has previously been placed in the hole and is mixed by the expansion shell and bolt. This pulls the expansion shell (50) along the machine threads (30) of the bolt (10) towards the conical camming nut (40). As this continues, the wedge fingers (70) of the expansion shell (50) are driven out into contact with the hole sides by the camming nut (40). Once the resistance between the hole sides and the wedge fingers (70) is greater than the resistance between the wedge fingers (70) and the camming nut (40), the bolt assembly (10) will be pulled into the hole more than the expansion shell (50) will be pulled along the bolt (10). This may occur relatively quickly if the wedge fingers (70) are so shaped that the ends anchor into the sides of the wall without being spread by the camming nut (40).

As has been discussed, an adhesive is frequently used in the anchoring process. The adhesive is contained in pouches which are placed in the hole before the bolt is inserted. Because the expansion shell (50) may be placed at the leading end of the threaded section (30) of the bolt portion (10), it may be necessary to shape the threaded nut portion (60) of the expansion shell (50) in such a way that the adhesive can flow past it when the mechanical anchor is inserted into the hole. As one example, if the expansion shell (50) has two wedge fingers (70), the threaded nut portion (60) can have a flattened shape wherein the wedge fingers (70) attach at the narrower sides. The flattened shape would create greater clearance between the threaded nut portion (60) and the sides of the hole, allowing adhesive to flow past the threaded nut portion (60) as the mechanical anchoring system is inserted into the hole. As another example, if an expansion shell (50) has three wedge fingers (70) attached to it, the threaded nut portion (60) could have a clover leaf shape wherein the wedge fingers (70) attach at the lobes of the clover leaf and the adhesive could flow past the threaded nut portion (60) through the interstices, or notches, between the lobes. Configurations with additional wedge fingers (70) would require other, perhaps similar, shapes.

The camming nut (40) may be fixed in its linear position in various ways and may also vary in its shape. If it is round, like a cone, it can have a rotational motion relative to the wedge fingers (70) and may be fixed to the shaft of the bolt portion (10) of the mechanical anchoring system. One means of doing this is to have machine threads internal to the camming nut (40) which match those of the machine threads (30) of the bolt portion (10). The camming nut (40) can then be screwed down to where the machine threads (30) end, thus fixing the linear and angular location of the camming nut (40). Other means of so fixing the camming nut (40) include crimping the camming nut (40) onto the bolt portion (10) of the mechanical anchoring system or welding the camming nut (40) to the bolt portion (10). If the bolt portion (10) has a larger diameter tapering down to a smaller diameter for the machine threads (30), then the camming nut (40) may be linearly located merely by it having an inner diameter sized between that of the machine threads (30) and the bolt portion (10) and being slid over the machine threads (30) to the taper section.

If it is desired that the camming nut (10) not have any rotational motion with respect to the expansion shell (50), it may be held in its linear location by a support washer and allowed to spin on the bolt portion (10). This is particularly desirable if the camming nut (10) is not round like a cone but instead has flat sides tapering from a large end to a smaller end to engage the wedge fingers (70). Such a support washer could be fixed in its linear position in many of the ways already discussed for the camming nut (40) such as internal threads, crimping or press fitting, welding, and a tapered shaft section.

Figure 8:
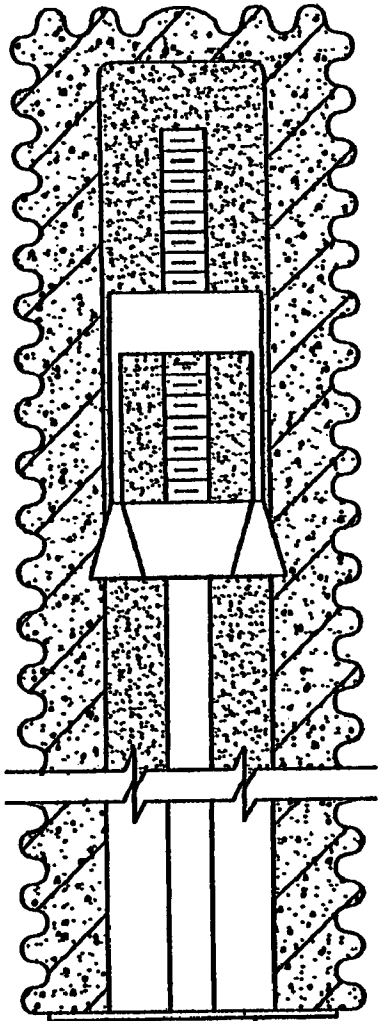
FIG. 8 shows an embodiment of the instant invention wherein the expansion shell has bails extending from it with wedges on each bail, which expansion shell moves along the lengthwise direction of the threaded section.
Figure 7:
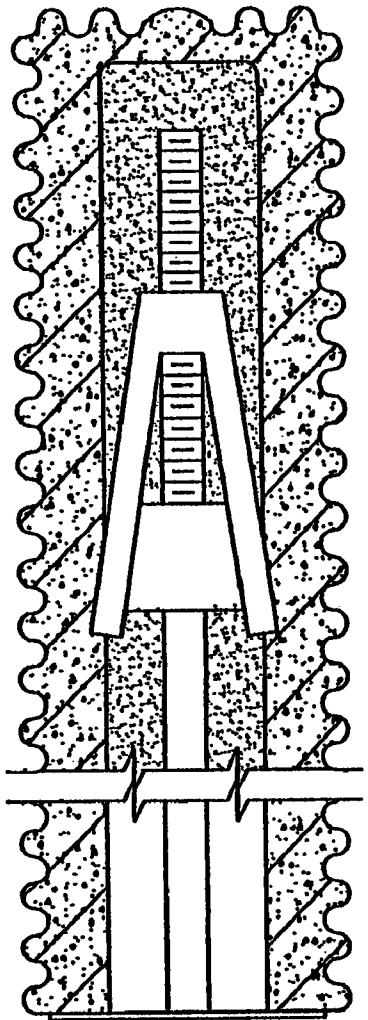
FIG. 7 shows an embodiment of the instant invention wherein the expansion shell moves along the lengthwise direction of the threaded section.
Figure 6:
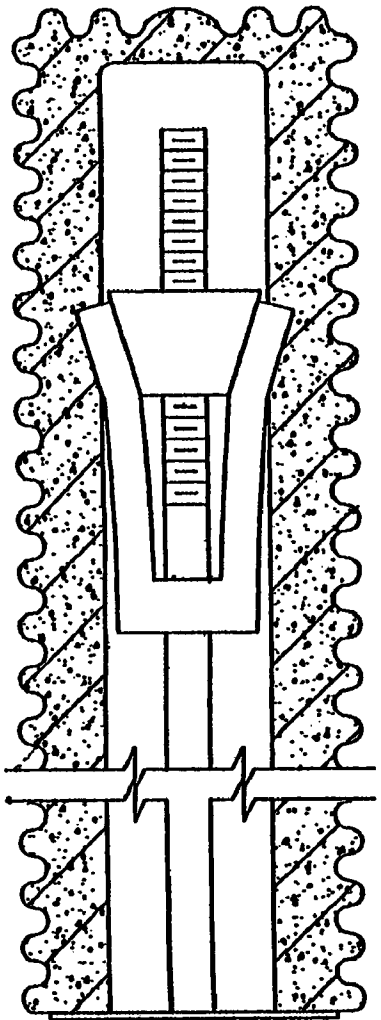
FIGURE 6 PRIOR ART
FIG. 6 shows an example of the current art wherein the camming nut moves along the lengthwise direction of the threaded section.

FIG. 8 shows an embodiment wherein the threaded nut portion of the expansion shell moves away from the linearly fixed camming nut as opposed to toward the camming nut. The wedge fingers are reduced to much thinner dimensions for most of their length with their ends expanding to wedge shapes that engage a camming nut which tapers away from the threaded nut portion. The wedge fingers may be reduced down to where they are essentially bails having the needed tensile strength to pull the wedge sections into engagement with the camming nut. Turning the bolt causes the threaded nut portion to move away from the camming nut, pulling the wedge sections into engagement with the camming nut, wedging the mechanical anchoring system into the sides of the hole. The camming nut may be rotationally fixed or it may be allowed to turn freely and held in linear location by a support washer. It may have a conical shape or flat sides.

Figure 9:
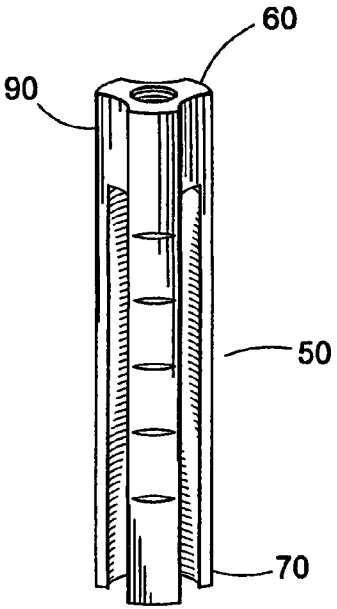
FIG. 9 shows an expansion shell having more than two wedge fingers.

FIGS. 9 through 17 illustrate some of these additional embodiments. FIG. 9 shows an expansion shell 50 having greater than two wedge fingers 70, in this case, three wedge fingers 70. Notches 90 in the periphery of threaded nut portion 60 allow the adhesive to flow past threaded nut portion 60 when the mine roof bolt is inserted into a hole in a mine ceiling.

Figure 10:
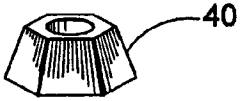
FIG. 10 shows a camming nut having flat sides to engage the wedge fingers.
Figure 11:
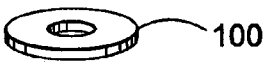
FIG. 11 shows a support washer for maintaining the location of a camming nut.

FIG. 10 shows a camming nut 40 with flat sides as opposed to a smooth conical shape. The number of flat sides must be at least that of the number of wedge fingers 70 on an accompanying expansion shell 50. If it is desired to use a camming nut 40 with flat faces on its incline, it must be able to spin on the bolt portion 10 of the mine roof bolt and match its rate of turn on the bolt portion 10 with that of the accompanying expansion shell 50. This free rotation is allowed by supporting the camming nut 40 with a support washer 100. Support washer 100 is shown in FIG. 11.

Figure 13:
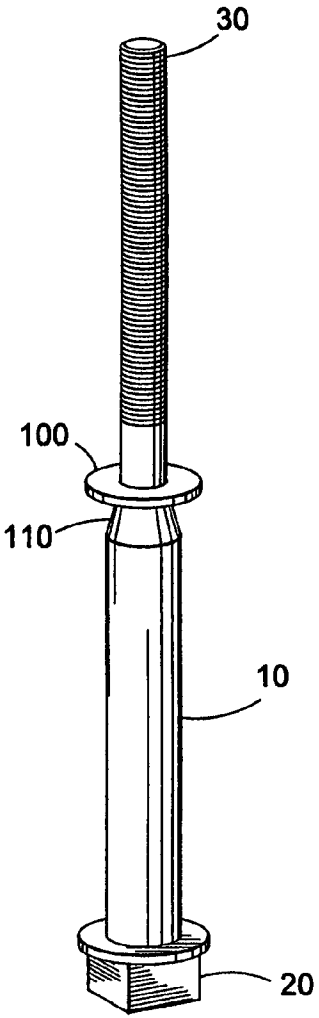
FIG. 13 shows the location of a support washer on the taper section.
Figure 12:
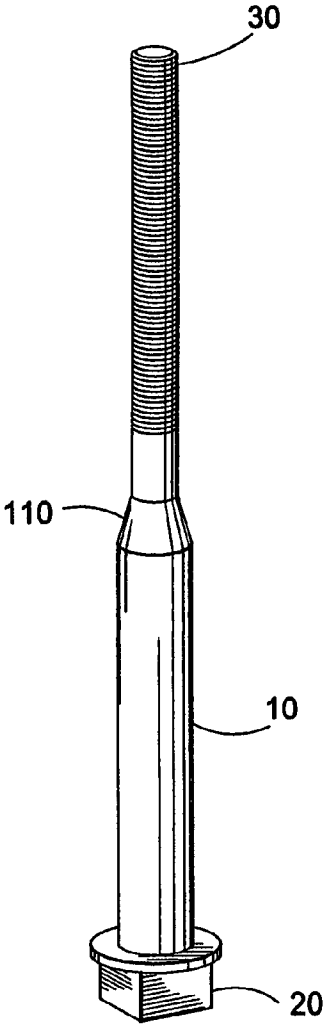

Support washer 100 can be fixed in position along the length of the mine roof bolt with various techniques including welding and crimping support washer 100 to mine roof bolt 10. FIG. 12 and FIG. 13 show another method by which support washer 100 can be held in place. The thread portion 30 in FIG. 12 and FIG. 13 is smaller in diameter than the rest of bolt portion 10. A taper section 110 transitions from smaller to larger diameter sections and the inner diameter of support washer 100 matches some diameter in that transition, probably one closer to the smaller diameter of the machine threads 30 than the larger diameter. This keeps the support washer 100 in a fixed location. A camming nut 40 resting on support washer 100 will be able to turn freely while being held in its longitudinal position by support washer 100.

Figure 14:
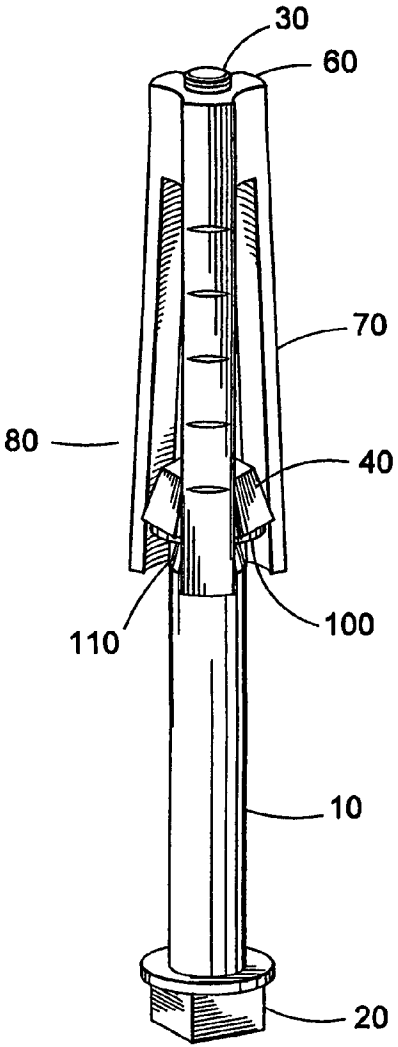
FIG. 14 shows the mine roof bolt apparatus assembled.

FIG. 14 shows support washer 100, camming nut 40 with flats, and expansion shell 50 with three wedge fingers 70 assembled onto bolt 10. Support washer 100 maintains camming nut 40 at fixed location while allowing camming nut 40 to turn about bolt 10 as expansion shell 50 advances along machine threads 30. Expansion shell 50 is advanced along machine threads 30 by turning bolt portion 10 of bolt assembly 80.

Figure 17:
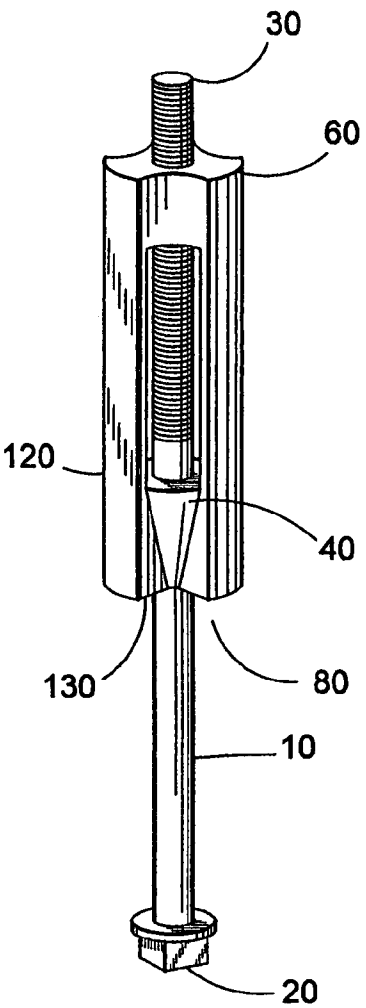
FIG. 17 shows an alternative embodiment of the mine roof bolt apparatus.
Figure 16:
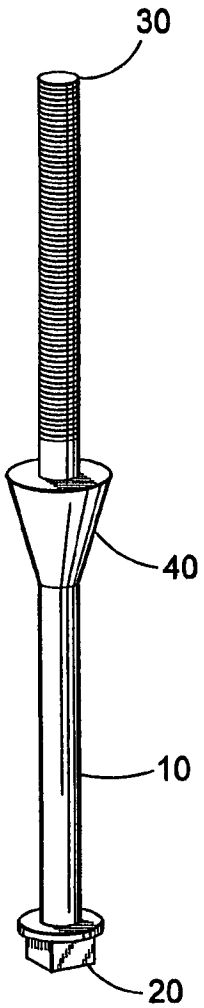
FIG. 16 shows a mine roof bolt having an inverted camming nut.
Figure 15:
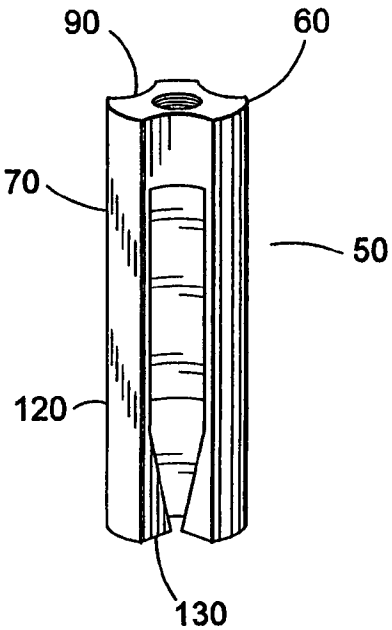
FIG. 15 shows an expansion shell having more than two wedge fingers comprising bail and wedge portions.

FIG. 15 through FIG. 17 illustrate another embodiment which is a further development of the embodiment illustrated in FIG. 8. FIG. 15 shows expansion shell 50 having more than two wedge fingers 70 wherein the wedge fingers 70 are reshaped to work in tension as opposed to compression. Notches 90 in threaded nut portion 60 allow adhesive to flow past threaded nut portion 60 as bolt assembly 80, seen in FIG. 17, is inserted into a mine roof hole. In this embodiment wedge fingers 70 have a bail section which is reduced down to bails 120 and a wedge section at the end which flair to a wedge 130. In this embodiment camming nut 40 is fixed along the length of bolt portion 10, but its largest diameter is nearest machine threads 30 while its smallest diameter is directed toward the driven end having means of turning 20 attached. The orientation of camming nut 40 for this embodiment can be seen in FIG. 16 and the interrelation of expansion shell 50 and its wedges 130 with camming nut 40 may be seen in FIG. 17.

To install bolt assembly 80 of FIG. 17, it is inserted upward into a mine roof hole and driven at the means for turning 20 to advance threaded nut portion 60 along machine thread 30. In this case, threaded nut portion 60 moves away from camming nut 40 and bails 120 pull wedges 130 into engagement with camming nut 40 which forces wedges 130 out. The resulting anchoring effect may be seen by referring back to FIG. 8.

In one embodiment, the quantity of machine threads (30) between the threaded nut portion (60) of the expansion shell (50) and the camming nut (40) serve as a timer. The combination of a driver operating at a typical speed with the selected quantity of machine threads (30) results in the expansion shell (50) traveling the needed distance in a predetermined amount of time.

I claimed:

1. A mine roof bolt comprising:

a) a shaft portion having machine threads on one end of said shaft;

b) a camming nut located in a fixed longitudinal location with respect to the end of said shaft, wherein said camming nut maintains said location during installation of said mine roof bolt; and c) an expansion shell having a threaded nut with a plurality of wedge fingers extending from the outer perimeter of said threaded nut, said wedge fingers being generally parallel to the axis of said threaded nut.

2. The mine roof bolt of claim 1 wherein said expansion shell features two said wedge fingers extending from the outer perimeter of said threaded nut.

3. The mine roof bolt of claim 2 wherein said threaded nut features a reduced cross-section in the portions of said threaded nut which do not feature wedge fingers attached thereto.

4. The mine roof bolt of claim 1 wherein said expansion shell features greater than two said wedge fingers extending from the outer perimeter of said threaded nut.

5. The mine roof bolt of claim 4 wherein said threaded nut is notched in its circumference at the portions of said threaded nut which do not feature wedge fingers attachments.

6. The mine roof bolt of claim 1 wherein the circumference of said camming nut tapers from a larger circumference on a first end to a smaller circumference on a second end, said smaller end directed toward said expansion shell.

7. The mine roof bolt of claim 6 wherein said camming nut features machine threads in its inner diameter, and wherein said camming nut is fixed in position by threading it onto said machined threads of said shaft portion of said roof bolt and turning said camming nut down to where the machine threads on said shaft portion end.

8. The mine roof bolt of claim 6 wherein said camming nut is fixed in position by crimping it onto said shaft portion.

9. The mine roof bolt of claim 6 wherein said camming nut is fixed in position by welding it to said shaft portion.

10. The mine roof bolt of claim 6 wherein:

(a) said shaft portion has a smaller diameter at said machine thread end and a larger diameter at the opposite end and a tapered transition section between said smaller and said larger diameter, and (b) said camming nut is held proximate said machine threads by having an inner diameter greater than said smaller diameter of said shaft but less than said larger diameter of said shaft and being placed in said tapered transition section.

11. The mine roof bolt of claim 6 wherein said camming nut features machine threads in its inner diameter, and wherein said camming nut is fixed in position by threading it onto said machined threads of said shaft portion of said roof bolt and turning said camming nut down to where the machine threads on said shaft portion end.

12. The mine roof bolt of claim 1 wherein said camming nut is held in said longitudinal location about said shaft portion by a support washer.

13. The mine roof bolt of claim 12 wherein said support washer features machine threads in its inner diameter, and wherein said support washer is fixed in position by threading it onto the machined threads of said shaft portion of said roof bolt and turning it down to where the machine threads on said shaft portion end.

14. The mine roof bolt of claim 12 wherein said support washer is fixed in position by crimping it onto said shaft portion.

15. The mine roof bolt of claim 12 wherein said support washer is fixed in position by welding it to said shaft portion.

16. The mine roof bolt of claim 12 wherein:

(a) said shaft portion has a smaller diameter at said machine thread end and a larger diameter at the opposite end and a tapered transition section between said smaller and said larger diameter, and (b) said support washer is held proximate said machine threads by having an inner diameter greater than said smaller diameter of said shaft but less than said larger diameter of said shaft and being placed in said tapered transition section.

17. The mine roof bolt of claim 1 wherein:

(a) said camming nut features a number of flat sides corresponding to at least the number of wedge fingers on an said expansion shell, and (b) said camming nut tapers from a larger end to a smaller end, said smaller end directed toward said threaded end of said shaft portion.

18. A mine roof bolt comprising:

(a) a shaft portion having machine threads on one end;

(b) an expansion shell having a threaded nut with a plurality of individual bails extending from said threaded nut generally parallel to the axis of the said threaded nut, said expansion shell being threaded onto said shaft portion;

(c) a wedge attached at the end of each said individual bails; and (d) a camming nut fixed in a longitudinal location on said shaft portion proximate to said machine threads and said wedges, wherein said camming nut maintains said location during installation of said mine roof bolt.

19. The mine roof bolt of claim 18 wherein said expansion shell features two said bails extending from said threaded nut.

20. The mine roof bolt of claim 18 wherein said threaded nut features a reduced diameter in the portions of said threaded nut which do not feature bails attached thereto.

21. The mine roof bolt of claim 18 wherein said expansion shell features greater than two said bails extending from said threaded nut.

22. The mine roof bolt of claim 21 wherein said threaded nut is notched in its circumference at the portions of said threaded nut where said bails are not attached.

23. The mine roof bolt of claim 18 wherein said camming nut is located on said shaft portion between said threaded nut and said wedges.

24. The mine roof bolt of claim 18 wherein said camming nut tapers from a larger circumference on a first end to a smaller circumference on a second end, said smaller circumference directed toward said wedges.

25. The mine roof bolt of claim 18 wherein said camming nut is fixed in position by crimping it onto said shaft portion.

26. The mine roof bolt of claim 18 wherein said camming nut is fixed in position by welding it to said shaft portion.

27. The mine roof bolt of claim 18 wherein:

(a) said camming nut has a number of flat sides equal to at least the number of said bails on an associated expansion shell, and (b) said camming nut tapers from a larger end to a smaller end, said smaller end directed towards said wedges on said bails.

28. The mine roof bolt of claim 18 wherein said camming nut is held in said longitudinal location by a support washer.

29. The mine roof bolt of claim 28 wherein said support washer is fixed in position by crimping it onto said shaft portion.

30. The mine roof bolt of claim 28 wherein said support washer is fixed in position by welding it to said shaft portion.

31. A method of anchoring a roof bolt in the roof of an underground mine comprising:

(a) drilling a hole into said roof of said underground mine;

(a) inserting into said hole, a roof bolt assembly comprised of:

(i) a mine roof bolt, threaded on one end, (ii) a camming nut fixed in its longitudinal position proximate said threaded end of said mine roof bolt, wherein said camming nut maintains said location during installation of said mine roof bolt; and (iii) a threaded expansion shell threaded onto said threaded mine roof bolt, (b) turning said threaded mine roof bolt so as to cause said threaded expansion shell to move along said threaded mine roof bolt and engage said camming nut, and wherein said camming nut is urged into said expansion shell causing said expansion shell to open and engage the adjacent rock formations of said mine roof.

32. The method of claim 31, wherein:

(a) prior to inserting said mine roof bolt, frangible pouches of adhesive constituent are inserted into said hole, and (b) the insertion and turning of said threaded mine roof bolt breaks said frangible pouches and mixes said adhesive constituents.

33. A method of anchoring a bolt in a bore hole comprising the steps of:

(a) threadedly engaging to the end of the bolt for axial movement thereon, an expansion shell having a plurality of longitudinally extending fingers, (b) positioning a camming nut on said bolt with the camming nut surrounded by said longitudinally extending fingers of the expansion shell on the bolt, (c) preventing movement of said camming nut along the axial direction on the bolt, and (d) moving said expansion shell on the bolt by rotation of said bolt to expand the fingers of said expandable shell upon the urging of said camming nut to anchor said expandable shell and said bolt connected thereto in the bore hole and applying a tension to said bolt.

34. A method of anchoring a bolt in a bore hole as set forth in claim 33 which further includes, (a) having a specified quantity of threads on said bolt, (b) having a predetermined distance between said camming nut and said fingers, and (c) turning said bolt at a selected rate such that the time required to engage said expansion shell onto said camming nut and cause, through said wedging action, said wedge fingers to expand and engage the sides of said bore hole, is predetermined.

35. A method of anchoring a bolt in a bore hole as set forth in claim 33 which includes, positioning a frangible container of an epoxy adhesive and bonding material in the bore hole ahead of said expandable shell, rotating said bolt within said bore hole to effect breakage of said frangible container and mixing of said epoxy adhesive material in said bore hole, and moving said expansion shell along said bolt to expand the fingers of said expansion shell in said bore hole to anchor said bolt.

36. A method of anchoring a bolt in a bore hole as set forth in claim 35 which further includes, (a) having a specified quantity of threads on said bolt, (b) having a predetermined distance between said camming nut and said fingers, and (c) turning said bolt at a selected rate such that the time required to engage said expansion shell onto said camming nut and cause, through said wedging action, said wedge fingers to expand and engage the sides of said bore hole, is predetermined.

37. A method of anchoring a bolt in a bore hole as set forth in claim 35 which further includes, having a specified quantity of threads on said bolt, having a predetermined distance between said camming nut and said fingers, turning said bolt at a selected rate such that the time required to engage said expansion shell onto said camming nut and cause, through said wedging action, said wedge fingers to expand and engage the sides of said bore hole corresponds with the time required for said epoxy bonding material to act upon said bolt to further anchor said bolt by bonding said bolt to the surrounding rock strata.

38. A method of anchoring a bolt in a bore hole comprising the steps of:

(a) threadedly engaging to the end of said bolt for axial movement thereon, an expandable shell having a plurality of longitudinally extending bails, each bail having a wedge affixed thereto, (b) positioning a camming nut on the bolt with the camming nut surrounded by the wedges affixed to the longitudinally extending bails of the expansion shell on the bolt, (c) preventing movement of the camming nut along the axial direction on the bolt, and (d) thereafter moving said expandable shell on said bolt by rotation of said bolt such that said camming plug expands the wedges affixed to the longitudinally extending bails of said expandable shell to anchor said expandable shell and said bolt connected thereto in the bore hole and applying a tension to said bolt.

39. A method of anchoring a bolt in a bore hole as set forth in claim 38 which includes, (a) having a selected quantity of threads on said bolt, a predetermined distance between said camming nut and said wedges on said longitudinal bails, and (b) turning said bolt at a selected rate, to anchor said bolt in a desired time.

* * * * *